US007199696B2

(12) United States Patent
Pauley, Jr. et al.

(10) Patent No.: US 7,199,696 B2
(45) Date of Patent: Apr. 3, 2007

(54) TRANSFORMER HAVING A STACKED CORE WITH A SPLIT LEG AND A METHOD OF MAKING THE SAME

(75) Inventors: William E. Pauley, Jr., Bland, VA (US); Charlie H. Sarver, Rocky Gap, VA (US); Rush B. Horton, Jr., Wytheville, VA (US)

(73) Assignee: ABB Technology AG, Zurich (CH)

( * ) Notice: Subject to any disclaimer, the term of this patent is extended or adjusted under 35 U.S.C. 154(b) by 12 days.

(21) Appl. No.: 11/093,551

(22) Filed: Mar. 30, 2005

(65) Prior Publication Data

US 2006/0226947 A1 Oct. 12, 2006

(51) Int. Cl.
*H01F 27/24* (2006.01)

(52) U.S. Cl. ..... 336/234; 336/217

(58) Field of Classification Search ..... 336/83, 336/212–217, 233, 234; 29/602, 609
See application file for complete search history.

(56) References Cited

U.S. PATENT DOCUMENTS 2,898,565 A * 8/1959 Fox et al. ..... 336/217
3,157,850 A * 11/1964 Winter et al. ..... 336/216
3,270,307 A * 8/1966 Jean et al. ..... 336/217
4,136,322 A 1/1979 Maezima
4,200,854 A * 4/1980 DeLaurentis et al. ..... 336/217
4,201,966 A 5/1980 De Laurentis
4,283,842 A * 8/1981 DeLaurentis et al. ..... 29/606
4,520,556 A 6/1985 Pasko, Jr. et al.
4,521,957 A * 6/1985 McLeod ..... 29/609
4,724,592 A 2/1988 Hunt et al.
5,959,523 A 9/1999 Westberg

FOREIGN PATENT DOCUMENTS

DE 3623271 A1 * 10/1986
JP 62-026805 * 2/1987
JP 04-251903 * 9/1992

OTHER PUBLICATIONS

U.S. Appl. No. 11/093,408, filed Mar. 30, 2005, William E. Pauly Jr. et al.

* cited by examiner

*Primary Examiner*—Tuyen T. Nguyen
(74) *Attorney, Agent, or Firm*—Paul R. Katterle

(57) ABSTRACT

The present invention is directed to a transformer having a stacked core, which includes top and bottom yokes and first and second outer legs. The core also includes an inner leg that is formed from a pair of stacked plates, which abut each along a seam that extends in the longitudinal direction of the inner leg. Each of the upper and lower yokes may be formed from a single stack of plates, or a plurality of stacks of plates. Each of the inner and outer legs may also be formed from a single stack of plates, or a plurality of stacks of plates. The cross-section of the core may be rectangular or cruciform.

13 Claims, 10 Drawing Sheets

TRANSFORMER HAVING A STACKED CORE WITH A SPLIT LEG AND A METHOD OF MAKING THE SAME

FIELD OF THE INVENTION

The invention relates to transformers and more particularly, to transformers having a stacked core and methods of making the same with reduced waste.

BACKGROUND OF THE INVENTION

A stacked transformer core is comprised of thin metallic laminate plates, such as grain oriented silicon steel. This type of material is used because the grain of the steel may be groomed in certain directions to reduce the magnetic field loss. The plates are stacked on top of each other to form a plurality of layers. A stacked core is typically rectangular in shape and can have a rectangular or cruciform cross-section. A front view of a conventional three leg stacked core 10 for a three phase transformer is shown in FIG. 1. The core 10 comprises an upper yoke 12, a lower yoke 14, an inner leg 16, and first and second outer legs 18, 20. A pair of windows 22 are disposed between the inner leg 16 and the first and second outer legs 18, 20, respectively. Wire coils (not shown) are mounted to the inner leg 16 and the first and second outer legs 18, 20, respectively.

The upper yoke 12 comprises a stack of plates 24, the lower yoke 14 comprises a stack of steel plates 26, the first outer leg 18 comprises a stack of plates 28 and the second outer leg 20 comprises a stack of plates 30. The plates 24, 26 of the upper and lower yokes 12, 14 have opposing ends that form joints with opposing ends of the plates 28, 30 of the first and second outer legs 18, 20, respectively. A V-shaped upper notch 32 is formed in each of the plates 24 of the upper yoke 12 and a V-shaped lower notch 36 is formed in each of the plates 26 of the lower yoke 14. The upper notches 32 form an upper groove 38 in the upper yoke 12, while the lower notches 36 form a lower groove 40 in the lower yoke 14. The size of the individual plates 24–30 vary depending on the stacking technique used to assemble the core 10.

The inner leg 16 comprises a stack of plates 42. Each of the plates 42 has an upper tined end 42*a* formed by a pair of miter cuts and a lower tined end 42*b* formed by a pair of miter cuts. The upper and lower tined ends 42*a, b* of the plates 42 provide the inner leg 16 with upper and lower tined ends 16*a, b*, which are adapted for receipt in the upper and lower grooves 38, 40 of the upper and lower yokes 12, 14, respectively.

The manufacture of the conventional core 10 described above results in a significant amount of steel being cut away and discarded. For example, during the manufacture of the inner leg 16, four pieces of steel must be cut away from each plate 42 to provide the plate 42 with tined ends. Therefore, it would be desirable to provide a stacked transformer core and a method of making the same that reduces the amount of steel that is discarded and, thus, wasted. The present invention is directed to such a transformer core and method.

SUMMARY OF THE INVENTION

In accordance with the present invention, a transformer is provided having a stacked core. The core is provided with a first yoke formed from a stack of plates and having an outer side and an inner side with a groove formed therein. The groove extends in a stacking direction of the plates and is located inwardly from the outer side. The core is also provided with a second yoke formed from a stack of plates and having an outer side and an inner side with a groove formed therein. The groove extends in the stacking direction of the plates and is located inwardly from the outer side. A first end of an inner leg is disposed in the groove of the first yoke and a second end of the inner leg is disposed in the groove of the second yoke. The inner leg includes a first stack of first plates abutting a second stack of second plates. A coil winding is mounted to the inner leg of the core.

Also provided in accordance with the present invention is a method of forming a transformer with a stacked core. In accordance with the method, a plurality of first and second outer leg plates is provided. A plurality of inner leg plates and a plurality of first yoke plates are also provided. Each of the first yoke plates has an outer side and an inner side with a notch formed therein. The notch is located inwardly from the outer side. The inner leg plates, the first yoke plates and the first and second outer leg plates are stacked to form first and second outer legs, a first yoke with a first groove, and an inner leg having a first end disposed in the first groove. The first outer leg is formed from the first outer leg plates, the second outer leg is formed from the second outer leg plates and the first yoke is formed from the first yoke plates. The inner leg is formed from a first stack of the inner leg plates abutting a second stack of the inner leg plates. The first groove extends in a stacking direction of the first yoke and is formed by the notches of the first yoke plates. The coil winding is mounted to the inner leg.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
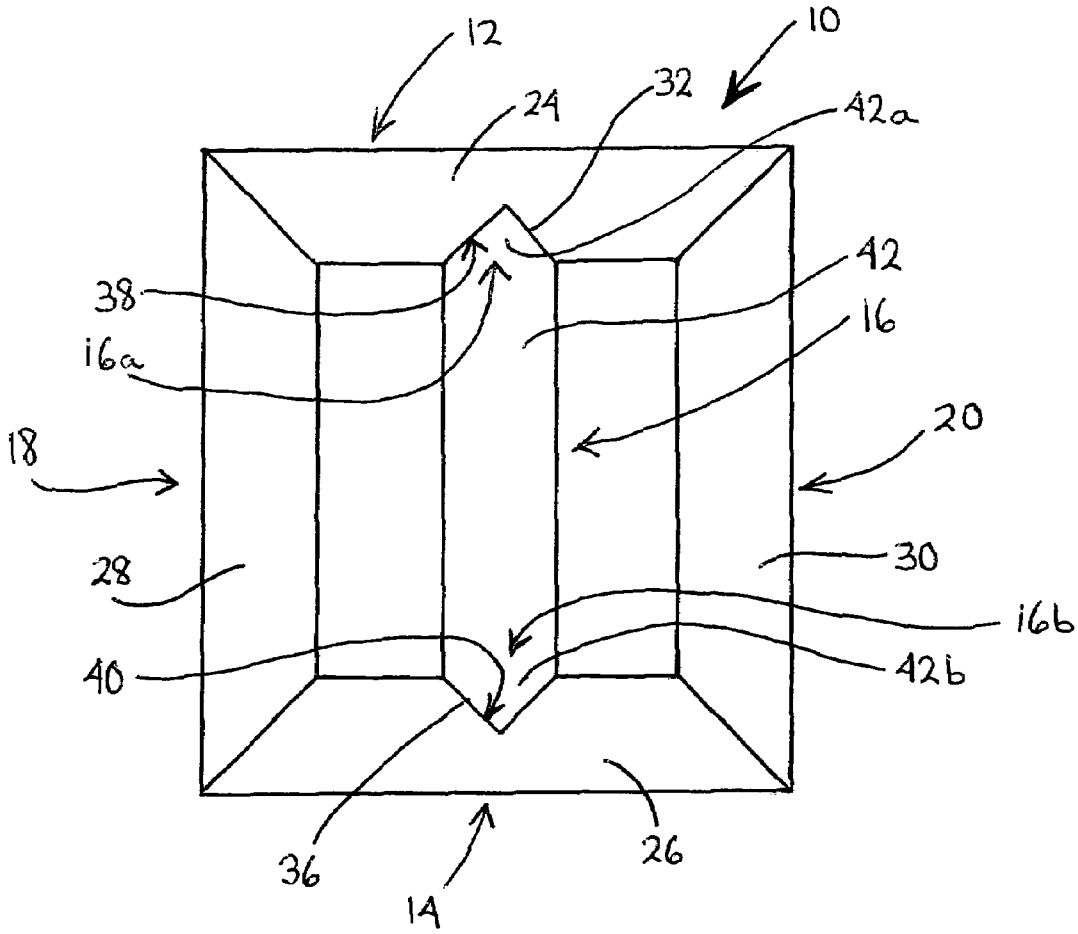
Fig. 1 PRIOR ART
FIG. 1 shows a front elevational view of a prior art transformer core.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Figure 2:
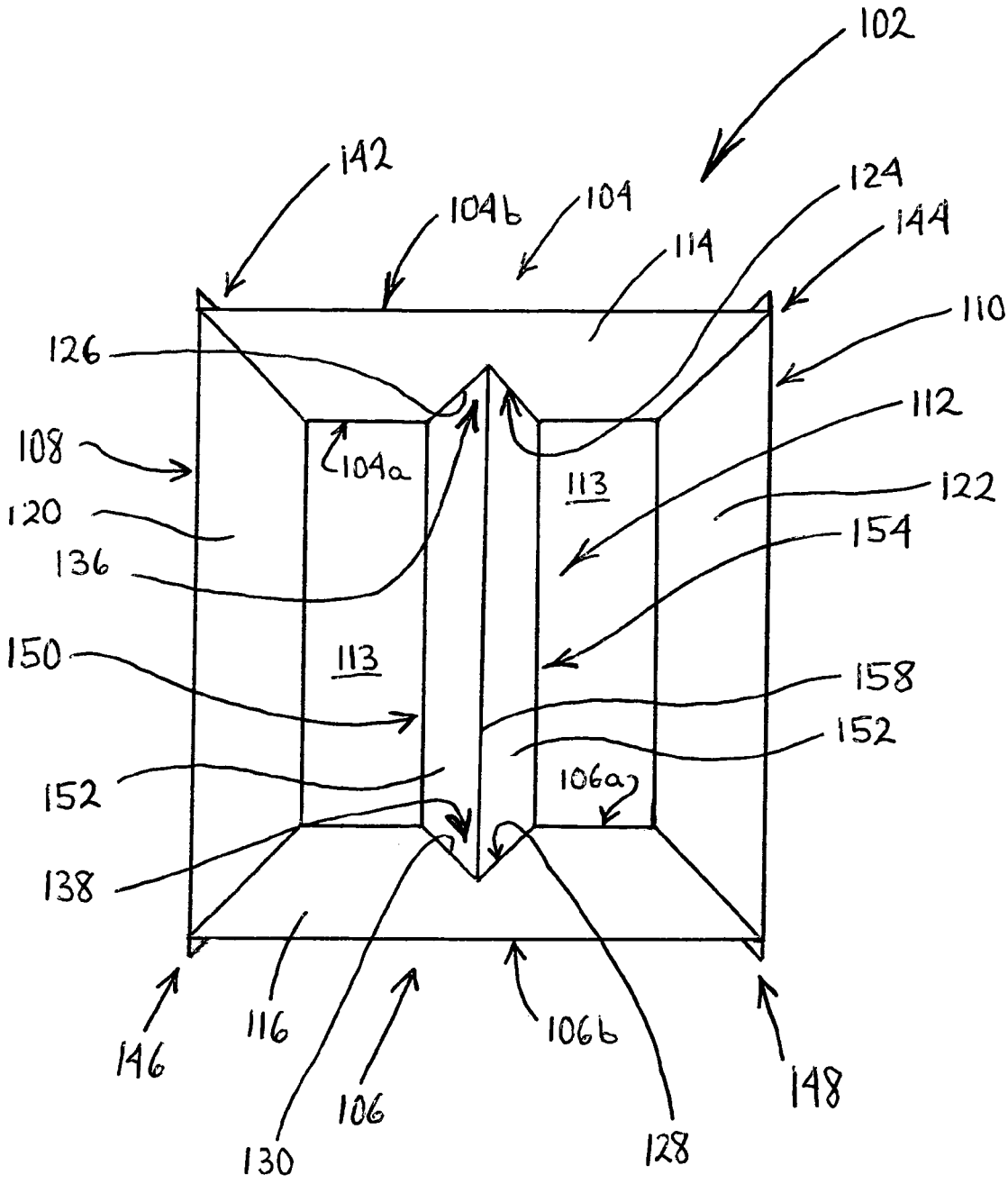
FIG. 2 shows a front elevational view of a transformer core constructed in accordance with a first embodiment of the present invention.

The present invention is directed to a transformer 100 (shown in FIG. 6), such as a distribution transformer, having a stacked core 102. The transformer 100 may be an oil-filled transformer, i.e., cooled by oil, or a dry-type transformer, i.e., cooled by air. The construction of the core 102, however, is especially suitable for use in a dry transformer. Referring now to FIG. 2, the core 102 has a rectangular shape and generally comprises an upper yoke 104, a lower yoke 106, first and second outer legs 108, 110 and an inner leg 112. Upper ends of the first and second outer legs 108, 110 are connected to first and second ends of the upper yoke 104, respectively, while lower ends of the first and second outer legs 108, 110 are connected to first and second ends of the lower yoke 106. The inner leg 112 is disposed about midway between the first and second outer legs 108, 110 and has an upper end connected to the upper yoke 104 and a lower end connected to the lower yoke 106. With this construction, two windows 113 are formed between the inner leg 112 and the first and second outer legs 108, 110.

The upper yoke 104 has an inner side 104*a* and an outer side 104*b*, and the lower yoke 106 has an inner side 106*a* and an outer side 106*b*. The upper yoke 104 comprises a stack of plates 114, while the lower yoke 106 comprises a stack of plates 116. Both the plates 114 and the plates 116 are arranged in groups. In one exemplary embodiment of the present invention, the groups are groups of seven. Of course, groups of different numbers may be used, such as groups of four, which are used herein for ease of description and illustration. Each of the plates 114, 116 is composed of grain-oriented silicon steel and has a thickness in a range of from about 7 mils to about 14 mils, with the particular thickness being selected based on the application of the transformer 100. The plates 114, 116 each have a unitary construction and are trapezoidal in shape. In each of the plates 114, 116, opposing ends of the plate 114, 116 are mitered at oppositely-directed angles of about 45°, thereby providing the plate 114, 116 with major and minor side edges. The plates 114 have the same width to provide the upper yoke 104 with a rectangular cross-section and the plates 116 have the same width to provide the lower yoke 106 with a rectangular cross-section. However, the lengths of the plates 114 are not all the same and the lengths of the plates 116 are not all the same. More specifically, the lengths within each group of plates 114 are different and the lengths within each group of plates 116 are different. The pattern of different lengths is the same for each group of plates 114 and the pattern of different lengths is the same for each group of plates 116. The difference in lengths within each group permits the formation of multi-step lap joints with plates 120, 122 of the first and second outer legs 108, 110 as will be described more fully below.

A V-shaped upper notch 124 is formed in each of the plates 114 of the upper yoke 104 by an upper interior edge 126 and a V-shaped lower notch 128 is formed in each of the plates 116 of the lower yoke 106 by a lower interior edge 130. The upper interior edges 126 in adjacent plates 114 of the upper yoke 104 have different depths for forming vertical lap joints with upper ends of inner leg plates 152 of the inner leg 112, as will be described more fully below. Similarly, the lower interior edges 130 in adjacent plates 116 of the lower yoke 106 have different depths for forming vertical lap joints with lower ends of the inner leg plates 152 of the inner leg 112, as will be described more fully below. The upper notches 124 form an upper groove 136 in the upper yoke 104, while the lower notches 128 form a lower groove 138 (shown best in FIG. 4) in the lower yoke 104. The upper groove 136 is located inwardly from the outer side 104*b*, and the lower groove 138 is located inwardly from the outer side 106*b*. The upper and lower grooves 136, 138 extend in the stacking directions of the upper and lower yokes 104, 106, respectively.

The first outer leg 108 comprises a stack of the plates 120, while the second outer leg 110 comprises a stack of the plates 122. Both the plates 120 and the plates 122 are arranged in groups of the same number as the plates 114, 116. Each of the plates 120, 122 is composed of grain-oriented silicon steel and has a thickness in a range of from about 7 mils to about 14 mils, with the particular thickness being selected based on the application of the transformer 100. The plates 120, 122 each have a unitary construction and are trapezoidal in shape. In each of the plates 120, 122, opposing ends of the plate are mitered at oppositely-directed angles of about 45°, thereby providing the plate 120, 122 with major and minor side edges. The plates 120 have the same width to provide the first outer leg 108 with a rectangular cross-section and the plates 122 have the same width to provide the second outer leg 110 with a rectangular cross-section. However, the lengths of the plates 120 are not all the same and the lengths of the plates 122 are not all the same. More specifically, the lengths within each group of plates 120 are different and the lengths within each group of plates 122 are different. The pattern of different lengths is the same for each group of plates 120 and the pattern of different lengths is the same for each group of plates 122. The difference in lengths within each group permits the formation of the multi-step joints with the plates 114, 116 of the upper and lower yokes 104, 106, as will be described more fully below.

Figure 3:
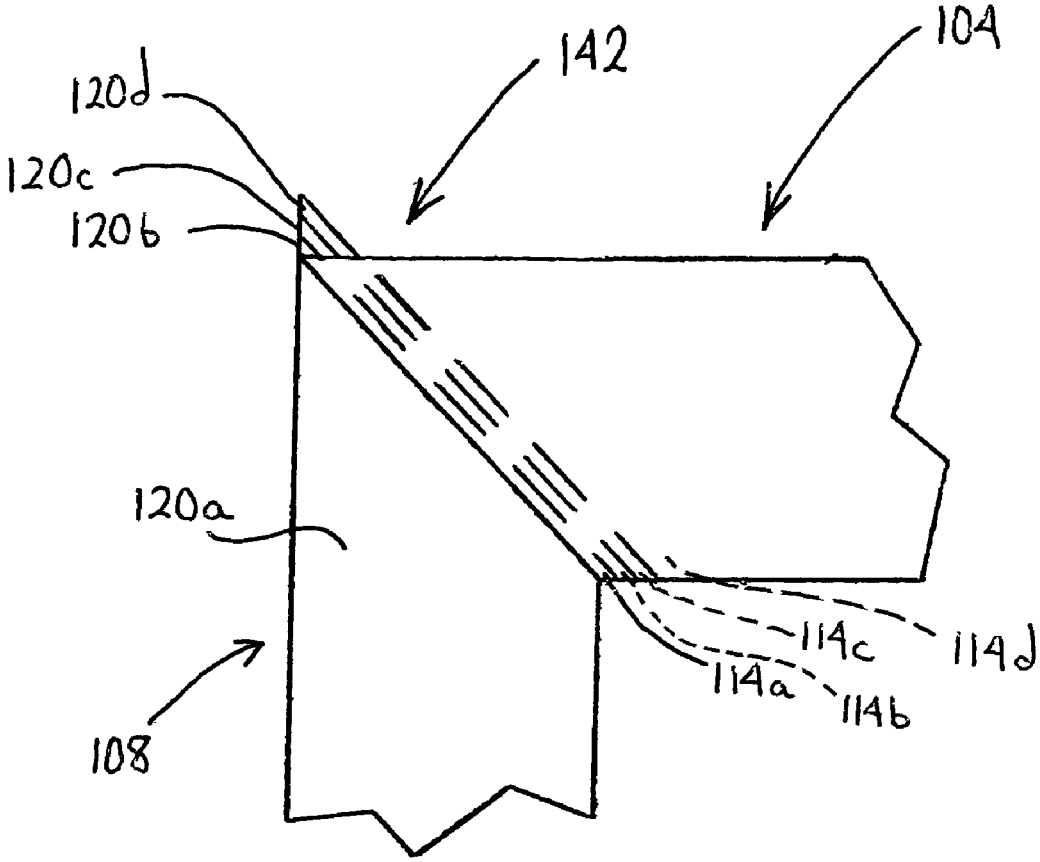
FIG. 3 shows a close-up view of a connection between a first outer leg and an upper yoke of the transformer core.

Referring now to FIG. 3 there is shown an enlarged view of a portion of the connection (represented by reference number 142) between the upper end of the first outer leg 108 and the first end of the upper yoke 104. More specifically, the ends of first, second, third and fourth plates 120*a, b, c, d* of the first outer leg 108 abut (form joints with) the ends of first, second, third and fourth plates 114*a*, 114*b*, 114*c*, 114*d* of the upper yoke 104, respectively. The first through fourth plates 120*a–d* of the first outer leg 108 and the first through fourth plates 14*a–d* of the upper yoke 104 are successively disposed farther inwardly. The first through fourth plates 120*a–d* have successively longer lengths, whereas the first through fourth plates 14*a–d* have successively shorter lengths. With this construction, the first plate 114*a* overlaps the joint between the second plates 114*b*, 120*b*, the second plate 114*b* overlaps the joint between the third plates 114*c*, 120*c* and the third plate 114*c* overlaps the joint between the fourth plates 114*d*, 120*d*. As shown, outer points of plates 120*b–d* of the first outer leg 108 protrude beyond the upper yoke 104. These outer points may be removed to improve the appearance of the core 102. Although not shown, additional groups of four plates 114, 120 are provided and repeat the pattern of the first through fourth plates 114*a–d* and the first through fourth plates 120*a–d*. In this manner, multi-step lap joints are formed between the plates 114 of the upper yoke 104 and the plates 120 of the first outer leg 108, with plates 114 of the upper yoke 104 overlapping plates 120 of the first outer leg 108.

The other connections (represented by reference numerals 144, 146, 148) between the first and second outer legs 108, 110 and the upper and lower yokes 104, 106 are constructed in the same manner as the connection 142 so as to have multi-step lap joints. It should be appreciated, however, that the connections 142–148 may have a different type of construction. For example, instead of the connections 142–148 having a four step lap joint pattern, the connections 142–148 may have a seven, or other number step lap joint pattern. In addition, instead of having plates 114, 116 of the upper and lower yokes 104, 106 overlapping plates 120, 122 of the first and second outer legs 108, 110, plates 120, 122 of the first and second outer legs 108, 110 may overlap plates 114, 116 of the upper and lower yokes 104, 106. With this construction, outer points of the plates 114, 116 would protrude beyond the first and second outer legs 108, 110, respectively.

The inner leg 112 comprises a first stack 150 of inner leg plates 152 and a second stack 154 of inner leg plates 152. In each of the first and second stacks 150, 154, the inner leg plates 152 are arranged in groups of the same number as the plates 114, 116. The first and second stacks 150, 154 abut each other along a seam 158 that extends in the longitudinal direction of the inner leg 112. Upper ends of the first and second stacks 150, 154 are disposed in the upper groove 136 of the upper yoke 104 and lower ends of the first and second stacks 150, 154 are disposed in the lower groove 138 of the lower yoke 106. The inner leg plates 152 form vertical multi-step lap joints with the plates 114, 116 of the upper and lower yokes 104, 106, as will be described further below. The inner leg plates 152 may all have the same length if the joints are offset by vertically shifting the inner leg plates 152. Alternately, the inner leg plates 152 may have a plurality of different lengths if the joints are offset by the different lengths of adjacent inner leg plates 152. Each of the inner leg plates 152 has a unitary construction and is trapezoidal in shape. In each of the inner leg plates, opposing ends of the inner leg plate 152 are mitered at oppositely-directed angles of about 45°, thereby providing the inner leg plate with major and minor side edges. The lengths of the inner leg plates 152 are determined by the major side edges. Each of the inner leg plates 152 is composed of grain-oriented silicon steel and has a thickness in a range of from about 7 mils to about 14 mils, with the particular thickness being selected based on the application of the transformer 100.

Figure 4:
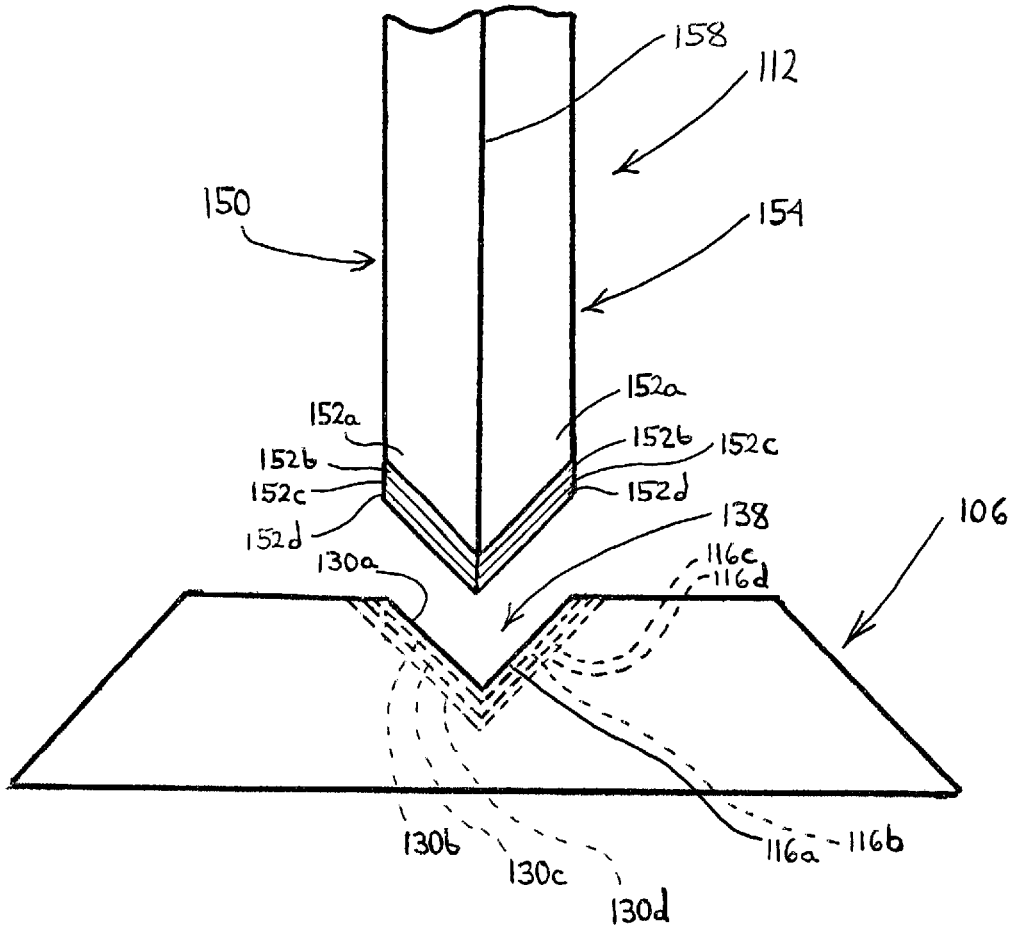
FIG. 4 shows an enlarged view of a portion of an inner leg spaced above a lower yoke of the transformer core.

Referring now to FIG. 4 there is shown an enlarged view of a portion of the lower end of the inner leg 112 spaced from the lower yoke 106. When the lower end of the inner leg 112 is disposed in the lower groove 138, the ends of first, second, third and fourth inner leg plates 152*a, b, c, d* of the first and second stacks 150, 154 abut (form joints with) the lower interior edges 130*a, b, c, d* of first, second, third and fourth plates 116*a, b, c, d* of the lower yoke 106, respectively. In each of the first and second stacks 150, 154, the first through fourth inner leg plates 152*a–d* are vertically offset such that lower ends thereof are located successively farther downward. In order to accommodate these differences in length, the lower interior edges 130*a–d* of the plates 116*a–d* are cut successively deeper. With this construction, the first plate 116*a* overlaps the joints between the second inner leg plates 152*b* and the second plate 116*b*, the second plate 116*b* overlaps the joints between the third inner leg plates 152*c* and the third plate 116*c*, and the third plate 116*c* overlaps the joints between the fourth inner leg plates 152*d* and the fourth plate 116*d*. Although not shown, additional groups of the plates 116 and inner leg plates 152 are provided and repeat the pattern of the first through fourth plates 152*a–d* and the first through fourth plates 116*a*–116*d*. In this manner, multi-step lap joints are formed between the plates 116 of the lower yoke 106 and the inner leg plates 152 of the first and second stacks 150, 154, with plates 116 of the lower yoke 106 overlapping plates 152 of the first and second stacks 150, 154.

Since the lower ends of the first through fourth inner leg plates 152*a–d* of the first and second stacks 150, 154 are located successively farther downward, upper ends of the first through fourth inner leg plates 152*a–d* of the first and second stacks 150, 154 are located successively farther downward. As a result, the upper interior edges 126 (and, thus, the upper notches 124) of the plates 114 within each group are successively shallower, which is the inverse of the lower yoke 106. With this construction, vertical multi-step lap joints are formed between the plates 114 of the upper yoke 104 and the first inner leg plates 152 of the first and second stacks 150, 154, with inner leg plates 152 overlapping plates 114 of the upper yoke.

It should be appreciated that the inner leg plates 152 of the first and second stacks 150, 154 may be offset differently so as to have plates 114 of the upper yoke 104 overlapping inner leg plates 152, and inner leg plates 152 overlapping plates 116 of the lower yoke 106. In addition, the inner leg plates 152 of the first and second stacks 150, 154 may be offset to form a seven or other number step lap joint pattern, instead of the four step lap joint pattern.

In the embodiment where the inner leg plates 152 have different lengths, such as four different lengths, vertical multi-step lap joints are formed between the plates 114, 116 of the upper and lower yokes 104, 106 in a manner similar to that described above, however, the upper interior edges 126 (and thus the upper notches 124) of the plates 114 of the upper yoke 104 may have the same arrangement as the lower interior edges 130 (and thus the lower notches 128) of the plates 116 of the lower yoke 106 with regard to depth, because there is no vertical shifting of the inner leg plates 152.

Figure 5:
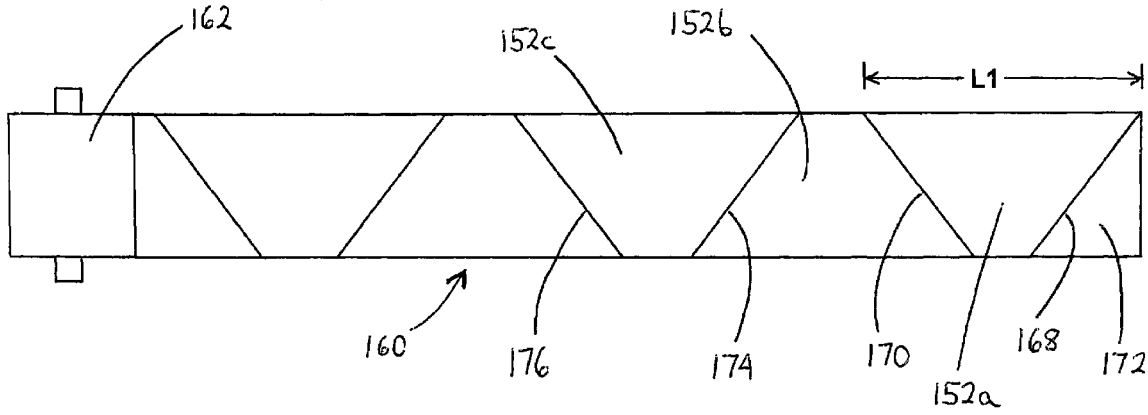
FIG. 5 shows a top plan schematic view of plates of inner leg plates being formed from a roll of steel.

Referring now to FIG. 5, the inner leg plates 152 are formed from one or more pieces of steel 160, which are typically received from a supplier in one or more rolls 162. The steel piece(s) 160 in the roll(s) 162 is/are unrolled and cut by a cutting machine (not shown), which is operable to make two or more cuts simultaneously. In the description below, the cutting machine is operable to make two cuts simultaneously. The cuts are made at oppositely directed angles of about 45° and are separated so as to form an inner leg plate 152 with a length of L1, i.e., a major side length of L1. FIG. 5 shows a portion of a steel piece 160 that has been unwound from its roll 162 and is being cut by the cutting machine. The cutting machine makes a first cut 168 and a second cut 170 in the steel piece 160 simultaneously. The first and second cuts 168, 170 form a first inner leg plate 152*a* and a scrap piece 172, which is discarded. The steel piece 160 is then further unwound and advanced (relative to the cutting machine) by the distance L1. The cutting machine makes a third cut 174 and a fourth cut 176 in the steel piece 160 simultaneously. The third and fourth cuts 174, 176 form a second inner leg plate 152*b* and a third inner leg plate 152*c*. This procedure of unwinding, advancing and cutting is continued until the required number of inner leg plates 152 is formed.

In the description of the cutting of the inner leg plates set forth above, the inner leg plates 152 all have the same length L1. If the inner leg plates 152 are provided with different lengths, such as L1–L4, the requisite number of inner leg plates 152 with the length L1 may be cut first. The cutting machine may then be reconfigured to change the spacing of the cuts and the advancement distance of the steel piece 160 so as to produce plates having a length L2. The requisite number of inner leg plates with L2 may then be cut. In a similar manner, the cutting machine is reconfigured and run to produce the requisite number of inner leg plates 152 with lengths L3 and L4.

Figure 6:
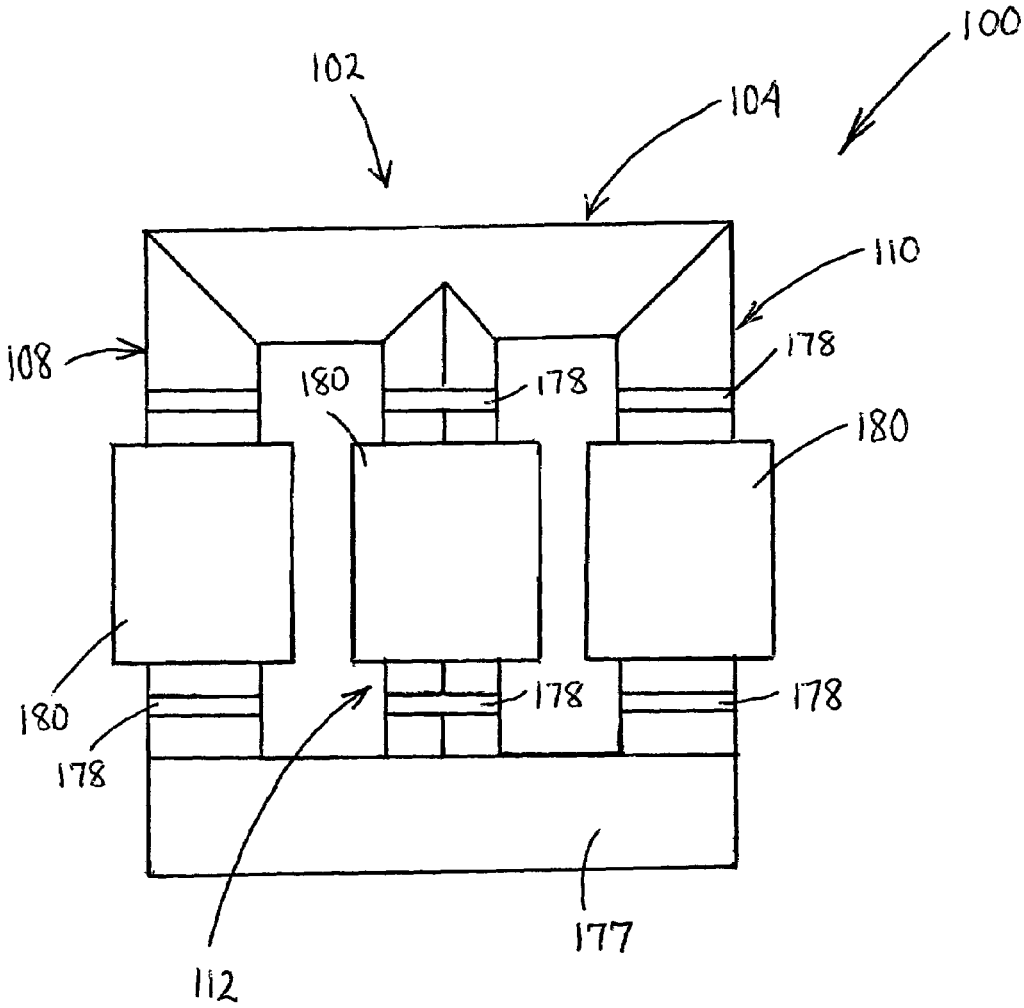
FIG. 6 shows a front elevational view of a transformer with the transformer core.

The method of assembling the core 102 is dependent on the size of the core 102. If the core 102 is large, such as would be the case if the transformer 100 was greater than 3000 kva, the core 102 is assembled with the lower yoke 106, the inner leg 112 and the first and second outer legs 108, 110 initially being disposed horizontally, i.e., the lower yoke 106, the inner leg 112 and the first and second outer legs 108, 110 are stacked in a vertical direction. In such a case the core 102 is assembled on a mounting fixture in a plurality of layers. In a first layer, a group of plates 116 is laid on the mounting fixture, with the major side edges disposed outwardly. Next, a group of plates 120 and a group of plates 122 are laid on the mounting fixture, with their major side edges disposed outwardly and their ends abutting the ends of the group of plates 116, respectively, to form multi-step lap joints. First and second groups of offset inner leg plates 152 are then laid on the mounting fixture, with the major side edges of the inner leg plates 152 of the first group abutting the major side edges of the inner leg plates 152 of the second group, and the ends of the inner leg plates 152 of the first and second groups abutting opposing portions of the lower interior edges 130 of the plates 116, respectively, to form two series of multi-step vertical lap joints, respectively. This laying process is repeated for each layer until a desired stacking configuration is achieved. Once the lower yoke 106, the inner leg 112 and the first and second outer legs 108, 110 have been formed, the lower yoke 106 is clamped between a pair of end frames or supports 177 and bands 178 are disposed around the inner leg 112 and the first and second outer legs 108, 110, respectively, as shown in FIG. 6. The partially formed core 102 is then moved to an upright position so that the inner leg 112 and the first and second outer legs 108, 110 extend vertically. Coil windings 180 are then disposed over the inner leg 112 and the first and second outer legs 108, 110, respectively. The upper yoke 104 is then stacked in groups of plates 114 onto the ends of the inner leg 112 and the first and second outer legs 108, 110.

If the core 102 is smaller, such as would be the case if the transformer 100 was less than 3000 kva, the core 102 is assembled in a similar manner as described above, except the core 102 is formed while being disposed vertically, i.e., the components of the core 102 are stacked in a horizontal direction.

After the core 102 with the coil windings 180 is fully constructed, the core 102 is enclosed within a housing (not shown). If the transformer 100 is an oil-filled type of transformer, the core 102 is immersed in oil within a compartment in the housing. If the transformer 100 is a dry-type of transformer, the core 102 is not immersed in oil and the housing is provided with louvers to permit air to enter the housing and pass over the core 102 and the coil windings 180.

Although the assembly of the core 102 set forth above describes three coil windings 180 being mounted to the core 102, such as occurs when the transformer 100 is a three-phase transformer, it should be appreciated that in another embodiment, a single coil winding 180 may be mounted to the inner leg 112 of the core 102, such as occurs when the transformer 100 is a single phase transformer. In another embodiment, three inner legs 190 may be provided, wherein the coil windings 180 are mounted to the inner legs 190, respectively. In such a case, three upper grooves 136 would be formed in the upper yoke 104 and three lower grooves 138 would be formed in the lower yoke 106. In addition, four windows 113 would be formed.

Figure 7:
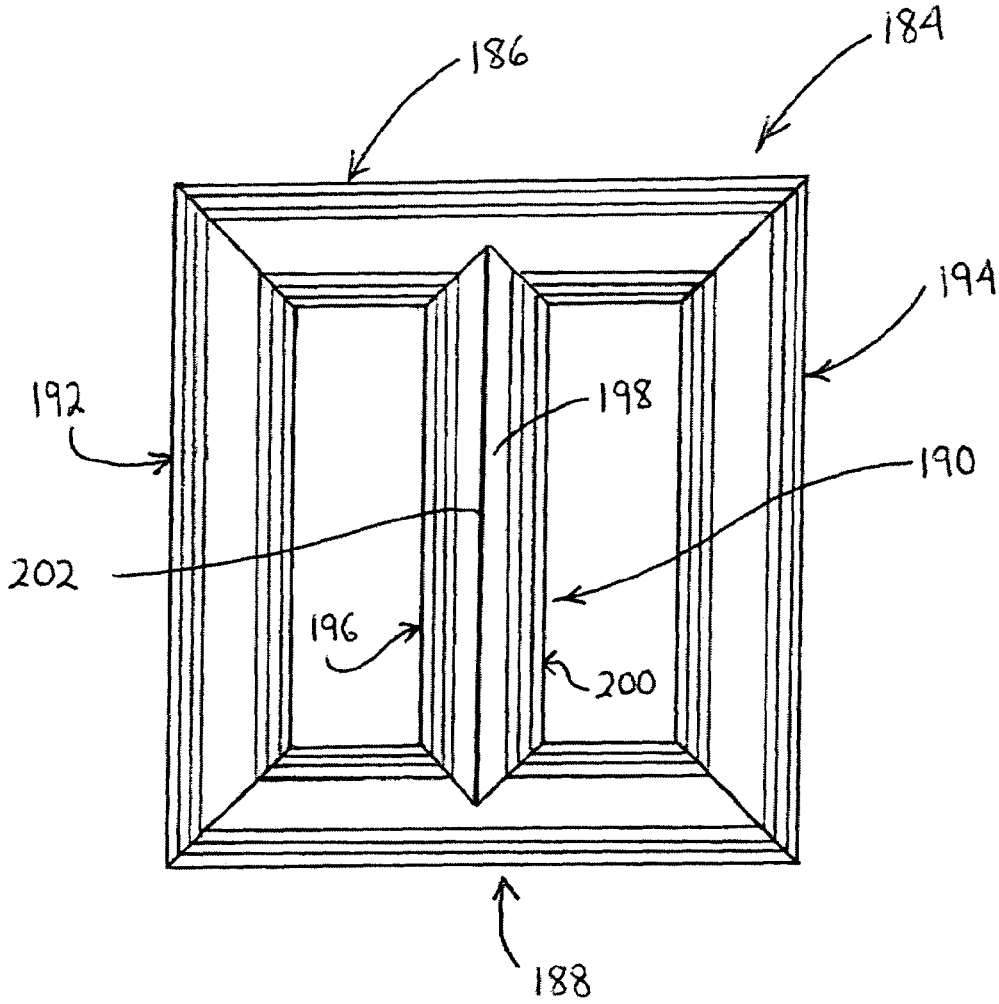
FIG. 7 shows a front elevational view of a second transformer core embodied in accordance with a second embodiment of the present invention.
Figure 8:
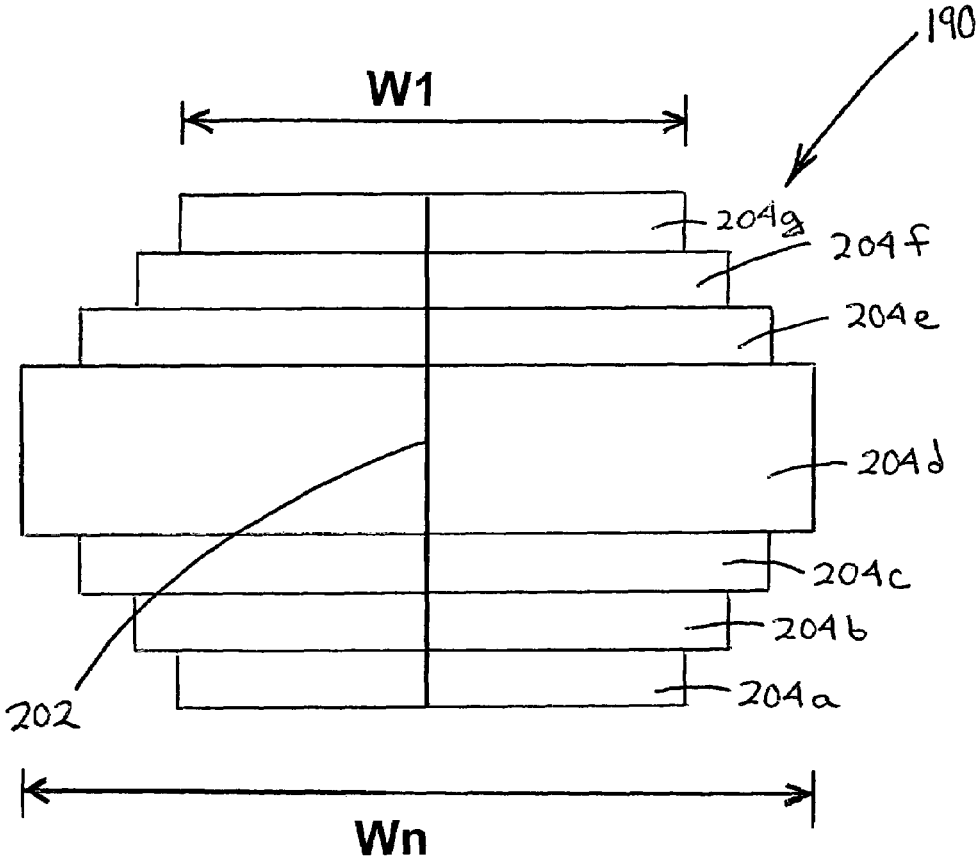
FIG. 8 shows a cross-sectional view of an inner leg of the second transformer core.

Referring now to FIG. 7, there is shown a core 184 embodied in accordance with a second embodiment of the present invention. The core 184 has substantially the same construction as the core 102, except for the differences set forth below. The core 184 comprises upper and lower yokes 186, 188 an inner leg 190 and first and second outer legs 192, 194. The inner leg 190 comprises a first stack 196 of inner leg plates 198 and a second stack 200 of inner leg plates 198. The first and second stacks 196, 200 abut each other along a seam 202 that extends in the longitudinal direction of the inner leg 190. Each of the upper and lower yokes 186, 188 the inner leg 190 and the first and second outer legs 192, 194 has a cruciform cross-section, instead of a rectangular cross-section, as in the core 102. The cruciform cross-sections of these components increase the strength of the core 184 and provide the inner leg 190 and the first and second outer legs 192, 194 with larger surface areas for supporting coils. The cruciform cross-sections of the components of the core 184 are formed by providing the constituent plates of the components with different widths. For example, and with reference now to FIG. 8, sections 204*a,b,c,d,e,f,g* of the inner leg plates 198 first successively increase in width and, then after the midpoint, successively decrease in width. The sections 204*a,b,c,d,e,f,g* each comprise one or more groups of inner leg plates 198. Thus, the outermost inner leg plates 198 in sections 204*a* and 204*g* each have a width W1, which is the smallest of the widths of the inner leg plates 198, and the inner leg plates 198 in the middle section 204*d* each have a width Wn, which is the largest of the widths of the inner leg plates 198. In each of first and second stacks 196, 200, the major side edges of the inner leg plates 198 are aligned at the seam 202. The different widths, however, cause the minor sides to be offset, which helps form the cruciform cross-section of the inner leg 190. The thickness of the sections 204*a–g* in the stacking direction may vary. For example, as shown, the center section 204*d* may be substantially thicker than the other sections 204*a,b,c,e,f,g*.

The components of the core 184 are cut and assembled in substantially the same manner as the components of the core 102, except for each component, a plurality of steel pieces with different widths (configured in a plurality of rolls) are cut to form the constituent plates of varying width.

Figure 9:
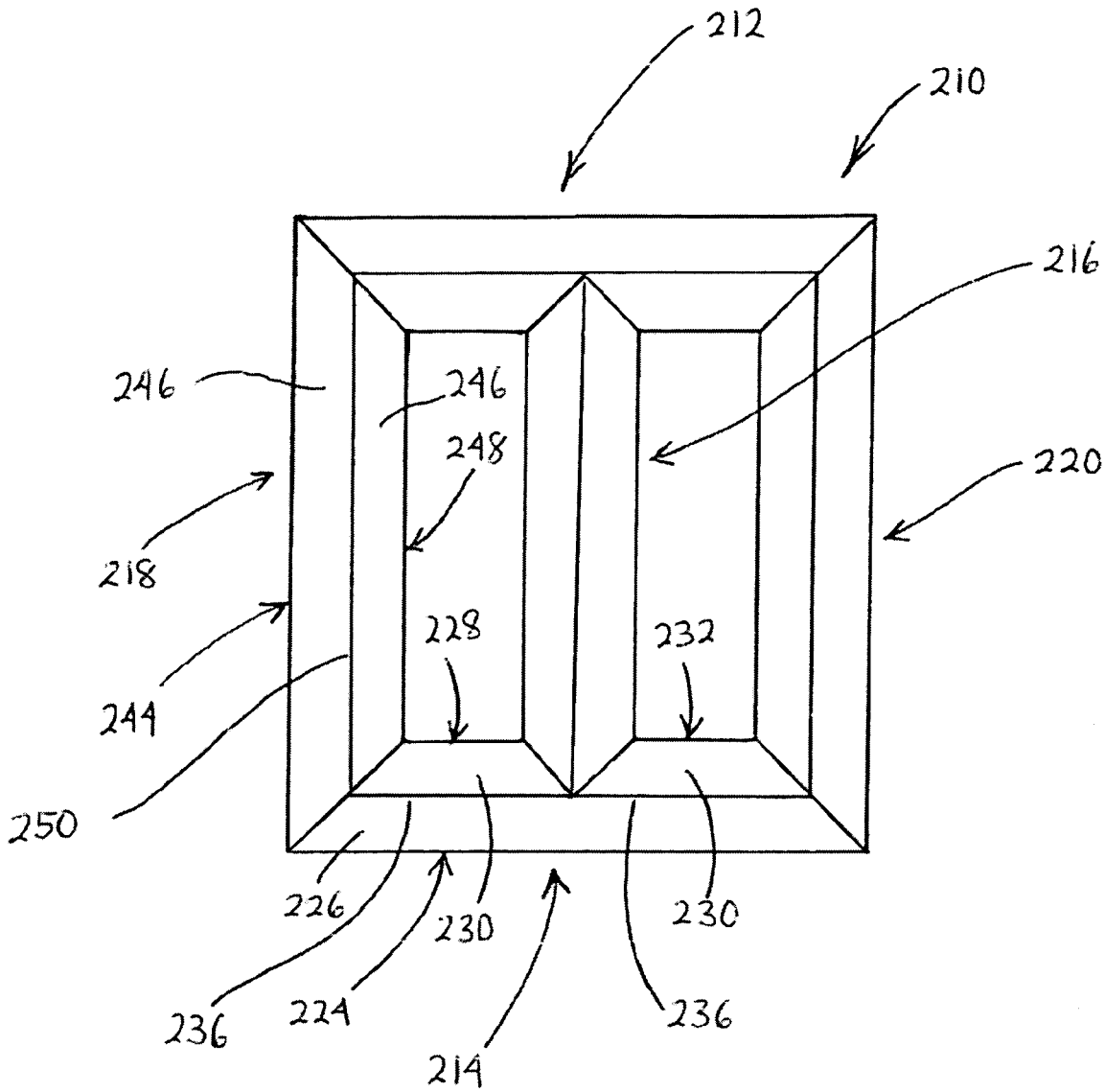
FIG. 9 shows a front elevational view of a third transformer core embodied in accordance with a third embodiment of the present invention.

Referring now to FIG. 9, there is shown a core 210 embodied in accordance with a third embodiment of the present invention. The core 210 has substantially the same construction and is constructed in substantially the same manner as the core 102, except for the differences set forth below. The core 210 comprises upper and lower yokes 212, 214, an inner leg 216 and first and second outer legs 218, 220. Like the inner leg 112 of the core 102, the inner leg 216 is comprised of a pair of stacks of plates. Unlike the upper and lower yokes 104, 106 in the core 102, however, the upper and lower yokes 212, 214 of the core 210 are comprised of a plurality of stacks of plates. The upper and lower yokes 212, 214 are constructed in a similar manner and, thus, for purposes of brevity only the lower yoke 212 will be described.

The lower yoke 214 of the core 210 comprises an outer stack 224 of first plates 226, a first inner stack 228 of second plates 230 and a second inner stack 232 of second plates 230. As with the lower yoke 106 of the core 102, the outer stack 224 and the first and second inner stacks 228, 232 are arranged in groups of plates to form multi-step lap joints. More specifically, within each group of the second plates 230 of the first and second inner stacks 228, 232, the inner ends of the second plates 230 are offset, either by shifting the second plates 230, or by providing the second plates 230 with different lengths. The groups in the first and second inner stacks 228, 232 are arranged in the same manner and are aligned so as to form pairs of corresponding second plates 230 (from the first and second inner stacks 228, 232 respectively). Each of the first plates 226 is unitary in structure and has an elongated trapezoidal shape, with major and minor side edges. The first plates 226 have opposing ends that form multi-step lap joints with plates of the first and second outer legs 218, 220, respectively. A portion of the first plates 226 have V-shaped notches 234 formed therein. The second plates 230 each have major and minor side edges and outer mitered ends. The first and second inner stacks 228, 232 are disposed on the outer stack 224 such that the major side edges of the second plates 230 are disposed against the minor side edges of the first plates 226. The first and second inner stacks 228, 232 abut the outer stack 224 along a pair of seams 236, respectively, that extend in the longitudinal direction of the outer stack 224. The first and second plates 226, 230 all have the same width and, thus, may be formed from the same piece of steel.

Figure 10:
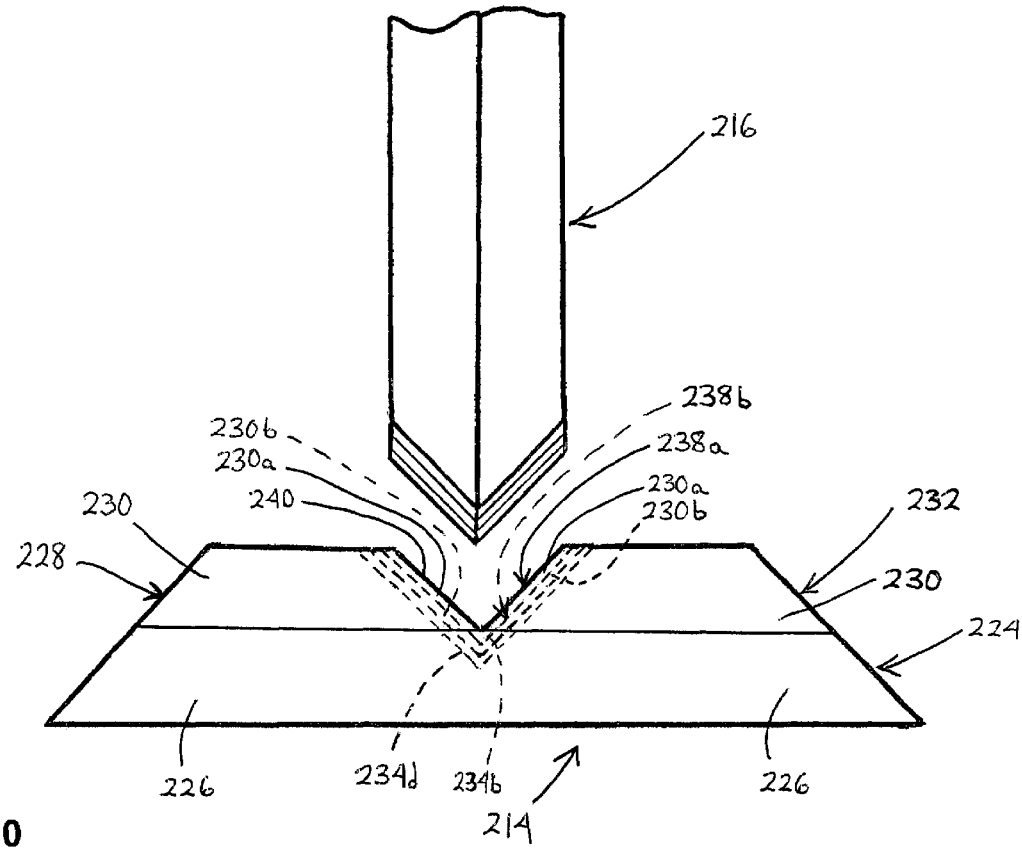
FIG. 10 shows an enlarged view of a portion of an inner leg spaced above a lower yoke in the third transformer core.

Referring now to FIG. 10, in each layer of the lower yoke 214, a V-shaped notch 238 is at least partially formed by inner ends of a pair of corresponding second plates 230 (from the first and second inner stacks 228, 232 respectively). In a first pair of corresponding second plates 230*a*, the second plates 230*a* have mitered inner ends that abut at a lower point, thereby forming a notch 238*a*. In a second pair of corresponding second plates 230*b*, inner ends of second plates 230*b* are separated by a spacing that cooperates with a notch 234*b* in a corresponding first plate 226*b* to form a notch 238*b*. In the remaining pairs of corresponding second plates 230, the inner ends of the second plates 230 are also spaced apart and cooperate with notches 234 in the first plates 226 to form notches 238. In this manner, a vertical series of multi-step V-shaped inner edges 240 (and, thus, the notches 238) is formed. In subsequent pairs of groups, the pattern repeats with the first pair of corresponding second plates 230 having abutting inner ends and the subsequent pairs of corresponding second plates 230 having spaced-apart inner ends. The inner edges 240 form multi-step vertical lap joints with lower ends of the inner leg plates of the inner leg.

The first and second outer legs 218, 220 may each be comprised of a single stack of plates, as in the core 102, or the first and second outer legs 218, 220 of the core 210 may each be comprised of a plurality of stacks of plates, as is shown in FIG. 9. The first and second out legs 218, 220 are constructed in a similar manner and, thus, for purposes of brevity, only the first outer leg 218 will be described.

The first outer leg 218 comprises a first stack 244 of leg plates 246 and a second stack 248 of leg plates 246. The first and second stacks 244, 248 abut each other along a seam 250 that extends in the longitudinal direction of the first outer leg 218. In both the first and second stacks 244, 248, the leg plates 246 are arranged in groups. The leg plates 246 each have a unitary construction and are trapezoidal in shape. The leg plates 246 in the first stack 244 have the same width as the leg plates 246 in the second stack 248. In each of the leg plates 246, opposing ends of the leg plate 246 are mitered at oppositely-directed angles of about 45°, thereby providing the leg plate 246 with major and minor side edges. The first and second stacks 244, 248 abut each other such that the major side edges of the leg plates 246 of the second stack 248 are disposed against the minor side edges of the leg plates 246 of the first stack 244. In both the first and second stacks 244, 248, the lengths within each group of leg plates 246 are different to permit the formation of multi-step lap joints with the plates of the upper and lower yokes 212, 214. The leg plates 246 in the first stack 244 may be formed from the same piece of steel as the leg plates 246 in the second stack 248.

A transformer core embodied in accordance with the present invention provides a number of benefits over conventional transformer cores. The construction of an inner leg of a core in a pair of stacks reduces the amount of steel that is cut away and discarded. For example, assuming that a layer of an inner leg is formed from one piece of rectangular steel, only two pieces of steel have to be discarded if the inner leg has two stacks, while six pieces of steel have to be discarded if the inner leg has only one stack. Of course, this savings increases when more than one layer is formed from a piece of steel, which is typically the case.

In addition to saving steel, the present invention also permits a core to be manufactured in sizes larger than the cutting machine and/or the steel pieces would otherwise permit. For example, assuming that the cutting machine can only cut a 16 inch wide piece of steel, or only a 16 inch wide piece of steel is available, the present invention permits a 32 inch wide inner leg (or other core component) to be constructed.

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

What is claimed is:

1. A transformer comprising:

(a.) a core comprising:

a first yoke comprising a stack of plates and having an outer side and an inner side with a groove formed therein, said groove extending in a stacking direction of the plates and being located inwardly from the outer side;

a second yoke comprising a stack of plates and having an outer side and an inner side with a groove formed therein, said groove extending in the stacking direction of the plates and being located inwardly from the outer side;

an inner leg having a first end disposed in the groove of the first yoke and a second end disposed in the groove of the second yoke, said leg comprising a first stack of first plates abutting a second stack of second plates, wherein edges of the first plates abut edges of the second plates; and (b.) a coil winding mounted to the inner leg.

2. The transformer of claim 1, wherein the core further comprises first and second outer legs extending between the first and second yokes, said first and second outer legs each comprising a stack of plates; and wherein the inner leg is disposed between the first and second outer legs.

3. The transformer of claim 2, wherein the first stack of the inner leg abuts the second stack of the inner leg along a seam extending in the longitudinal direction of the first and second stacks.

4. The transformer of claim 3, wherein the first plates of the first stack are equal in number to, and are aligned with, the second plates of the second stack so as to provide the inner leg with a plurality of layers, each of which comprises one of the first plates and one of the second plates; and wherein in each of the layers of the inner leg, the first plate has the same width as the second plate.

5. The transformer of claim 4, wherein the inner leg has a cruciform cross-section.

6. The transformer of claim 4, wherein the inner leg has a rectangular cross-section.

7. The transformer of claim 2, wherein the plates of the first and second outer legs each have opposing mitered ends, and each of the plates of the first and second yokes have opposing mitered ends;

wherein the mitered ends of the plates of the first outer leg forms first joints and second joints with the mitered ends of the plates of the first and second yokes, respectively; and wherein the mitered ends of the plates of the second outer leg forms third joints and fourth joints with the mitered ends of the plates of the first and second yokes, respectively.

8. The transformer of claim 7, wherein the first, second, third and fourth joints are multi-step lap joints.

9. The transformer of claim 7, wherein each of the plates of the first yoke is unitary.

10. The transformer of claim 7, wherein the stack of plates of the first yoke is a first stack of plates, and wherein the first yoke further comprises second and third stacks of plates, said second and third stacks abutting the first stack in a longitudinal direction of the first yoke, said second and third stacks each having an inner end and an outer end; and wherein the inner ends of the second and third stacks at least partially define the lower groove of the lower yoke.

11. The transformer of claim 1, wherein each of the plates of the first yoke has a V-shaped notch defined by an inner edge, said notches forming the groove of the first yoke;

wherein first ends of the first and second plates form the first end of the inner leg; and wherein the first ends of the first and second plates form joints with the inner edges of the first yoke.

12. The transformer of claim 11, wherein adjacent ones of the inner edges are vertically offset; and wherein adjacent ones of the first ends of the first plates are offset and adjacent ones of the first ends of the second plates are offset; and wherein the joints between the first ends of the first and second plates and the inner edges of the first yoke are vertical multi-step lap joints.

13. The transformer of claim 1, wherein the transformer is a dry-type transformer.

* * * * *